US010378777B2

(12) United States Patent
Sinur et al.

(10) Patent No.: US 10,378,777 B2
(45) Date of Patent: Aug. 13, 2019

(54) MODULAR RANGE VENT HOOD

(71) Applicant: Broan-NuTone LLC, Hartford, WI (US)

(72) Inventors: Richard R. Sinur, West Bend, WI (US); Brian R. Wellnitz, Grafton, WI (US)

(73) Assignee: Broan-NuTone LLC, Hartford, WI (US)

( * ) Notice: Subject to any disclaimer, the term of this patent is extended or adjusted under 35 U.S.C. 154(b) by 209 days.

(21) Appl. No.: 15/159,547

(22) Filed: May 19, 2016

(65) Prior Publication Data

US 2016/0341432 A1 Nov. 24, 2016

Related U.S. Application Data

(60) Provisional application No. 62/163,769, filed on May 19, 2015.

(51) Int. Cl.
*F24C 15/20* (2006.01)

(52) U.S. Cl.
CPC ..... *F24C 15/2028* (2013.01); *F24C 15/2071* (2013.01)

(58) Field of Classification Search
CPC ... F24C 15/2028; F24C 15/2071; F24C 15/20
(Continued)

(56) References Cited

U.S. PATENT DOCUMENTS 3,098,423 A * 7/1963 Giannini ..... F24C 15/2071 126/299 D
3,288,497 A * 11/1966 Nydam ..... F01N 13/08 285/148.23
(Continued)

FOREIGN PATENT DOCUMENTS

| | | | |
|---|---|---|---|
| EP | 2827067 | A2 | 1/2015 |
| WO | WO-2016/187460 | A1 | 11/2016 |
| WO | WO-2016/187467 | A1 | 11/2016 |

OTHER PUBLICATIONS

"International Application Serial No. PCT/US2016/033340, International Search Report dated Aug. 30, 2016", 2 pgs.
(Continued)

*Primary Examiner* — Avinash A Savani
*Assistant Examiner* — Rabeeul I Zuberi
(74) *Attorney, Agent, or Firm* — Barnes & Thornburg LLP

(57) ABSTRACT

A modular range hood having a backbone module attachable to a cabinet or other support structure, wherein a shell and at least one ventilation module can be coupled to the backbone module to provide desired aesthetic characteristics and/or functionality. The backbone module can have a mounting feature for receiving a fastener or configured to otherwise secure the backbone module to an underside mounting position of the cabinet or other support structure. The backbone module can provide a standardized base to which different shells and ventilation modules can be coupled to provide a modular range hood having the desired aesthetic characteristics and/or functionality. Similarly, the standardized backbone module can simplify installation by standardizing the mounting of the modular range hood to the cabinet or other support structure irrespective the shell and ventilation module attached to the range hood.

21 Claims, 9 Drawing Sheets

(58) Field of Classification Search
USPC ..... 126/299 R
See application file for complete search history.

(56) References Cited

U.S. PATENT DOCUMENTS

| | | | | |
|---|---|---|---|---|
| 4,133,300 | A | 1/1979 | Burton, Jr. et al. | |
| 4,266,528 | A * | 5/1981 | Barnhart | F24C 15/20 126/299 D |
| 4,614,177 | A * | 9/1986 | Buckley | F24C 15/2092 126/299 D |
| 5,961,264 | A | 10/1999 | Postadan | |
| 6,470,880 | B1 * | 10/2002 | Chang | F24C 15/20 126/299 D |
| 2006/0042622 | A1 | 3/2006 | Searer | |
| 2007/0099558 | A1 | 5/2007 | Oagley et al. | |
| 2007/0256681 | A1 | 11/2007 | Chiang et al. | |
| 2012/0018246 | A1 | 1/2012 | Pietro et al. | |
| 2013/0233295 | A1 * | 9/2013 | Oagley | F24C 15/20 126/299 D |
| 2014/0283356 | A1 * | 9/2014 | Nakayama | C12M 25/14 29/428 |
| 2014/0352132 | A1 * | 12/2014 | Bruin-Slot | A47B 77/08 29/525.02 |
| 2014/0352151 | A1 | 12/2014 | Bruin-Slot et al. | |
| 2015/0047198 | A1 | 2/2015 | Bruin-Slot et al. | |
| 2015/0114384 | A1 | 4/2015 | Bruin-Slot | |
| 2016/0341433 | A1 | 11/2016 | Gauthier et al. | |

OTHER PUBLICATIONS

"International Application Serial No. PCT/US2016/033340, Written Opinion dated Aug. 30, 2016", 7 pgs.
"International Application Serial No. PCT/US2016/033349, International Search Report dated Aug. 22, 2016", 2 pgs.
"International Application Serial No. PCT/US2016/033349, Written Opinion dated Aug. 22, 2016", 6 pgs.

* cited by examiner

MODULAR RANGE VENT HOOD

CLAIM OF PRIORITY

This patent application claims the benefit of priority, under 35 U.S.C. Section 119(e), to Rick Sinur et al. U.S. Patent Application Ser. No. 62/163,769, entitled "MODULAR. RANGE VENT HOOD," filed on May 19, 2015, each of which is hereby incorporated by reference herein in its entirety.

TECHNICAL FIELD

This document pertains generally, but not by way of limitation, to systems and related methods for modular installation of range vent hoods.

BACKGROUND

Manufacturers of ventilation systems often develop many different models of a single product type each having different functional features or aesthetic characteristics for product types that consumers seek both functional and aesthetic aspects. For example, many different models having different functional and aesthetic features are developed for under cabinet range hoods. The different models can have different price points or ranges; different aesthetic appearances or materials; different functional components or features; or customer requested custom aesthetic or functional features. The different models can satisfy market needs, but can present substantial challenges to manufacturers and installers.

For example, the different functional and aesthetic features of the different models can require different types of parts, different sized or shaped parts, and tooling. The different part types or dimensions and tooling can substantially increase the cost of manufacturing and delay manufacturing as the manufacturing line must frequently be retooled to account for the different shapes and sizes of the different models. Similarly, differently sized and shaped models can require different installation methods or parts, which can confuse installers and require custom installation techniques and parts for each model.

The development of a plurality of different models can be necessary to satisfy the market needs, but the different parts or shape and size of the different models can present significant manufacturing and installation drawbacks.

OVERVIEW

The present inventors have recognized, among other things, that a problem to be solved can include standardizing manufacturing and installation of various range hoods models having different aesthetic and/or functional features. In an example, the present subject matter can provide a solution to this problem, such as by providing a modular range hood having a backbone module attachable to a cabinet or other support structure, wherein a shell and at least one ventilation module can be coupled to the backbone module to provide desired aesthetic characteristics and/or functionality. The backbone module can have at least one mounting feature for receiving a fastener or for otherwise securing the backbone module to an underside mounting position of the cabinet or other support structure. The backbone module can provide a standardized base to which different shells and ventilation modules can be coupled to provide a modular range hood having the desired aesthetic characteristics and/or functionality and also permit replacement of components improving serviceability of the range hood. Similarly, the standardized backbone module can simplify installation by standardizing the mounting of the modular range hood to the cabinet or other support structure irrespective the shell and ventilation module attached to the range hood.

In an example, different shells having different aesthetic appearances and/or functional features can be coupled to a standard backbone module to mount the shell to the cabinet or support structure and change the aesthetic characteristics or functionality of the modular range hood. In an example, the shell can be releasably coupled to the backbone module such that the shell can be decoupled from the backbone module and replaced without unmounting the backbone module. In an example, the backbone module can include at least one attachment feature that can be coupled to a corresponding coupling feature on the interchangeable shell for attaching the interchangeable shell to the backbone module. The different interchangeable shells can each have at least one coupling feature positioned to engage the corresponding attachment features. The different aesthetic appearances and functional features of the various interchangeable shells can result in the shells having different shapes and sizes. The attachment features and coupling feature positions can have standardized positions such that interchangeable shells having different aesthetic appearances and functional features can be mounted to the backbone module.

In an example, the backbone module can have a duct interface portion for coupling at least one ventilation module, such as a blower or filter assembly, to ventilation ducting for the building. The backbone module can have standardized attachment features such that various ventilation modules can be coupled to the backbone module to change the functionality of range hood. Similarly, the backbone module can have releasable attachment features such that the ventilation modules can be decoupled from the backbone module for repair or replacement with a new ventilation module. In an example, the ventilation modules can be stacked to provide additional functionality for the modular range hood. For an example, a blower ventilation module can be mounted to the back bone module proximate the opening for the duct system to create an airflow into the duct system. In this configuration, a filter ventilation module can be stacked upstream of the blower ventilation to filter the airflow entering the duct system.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 13:
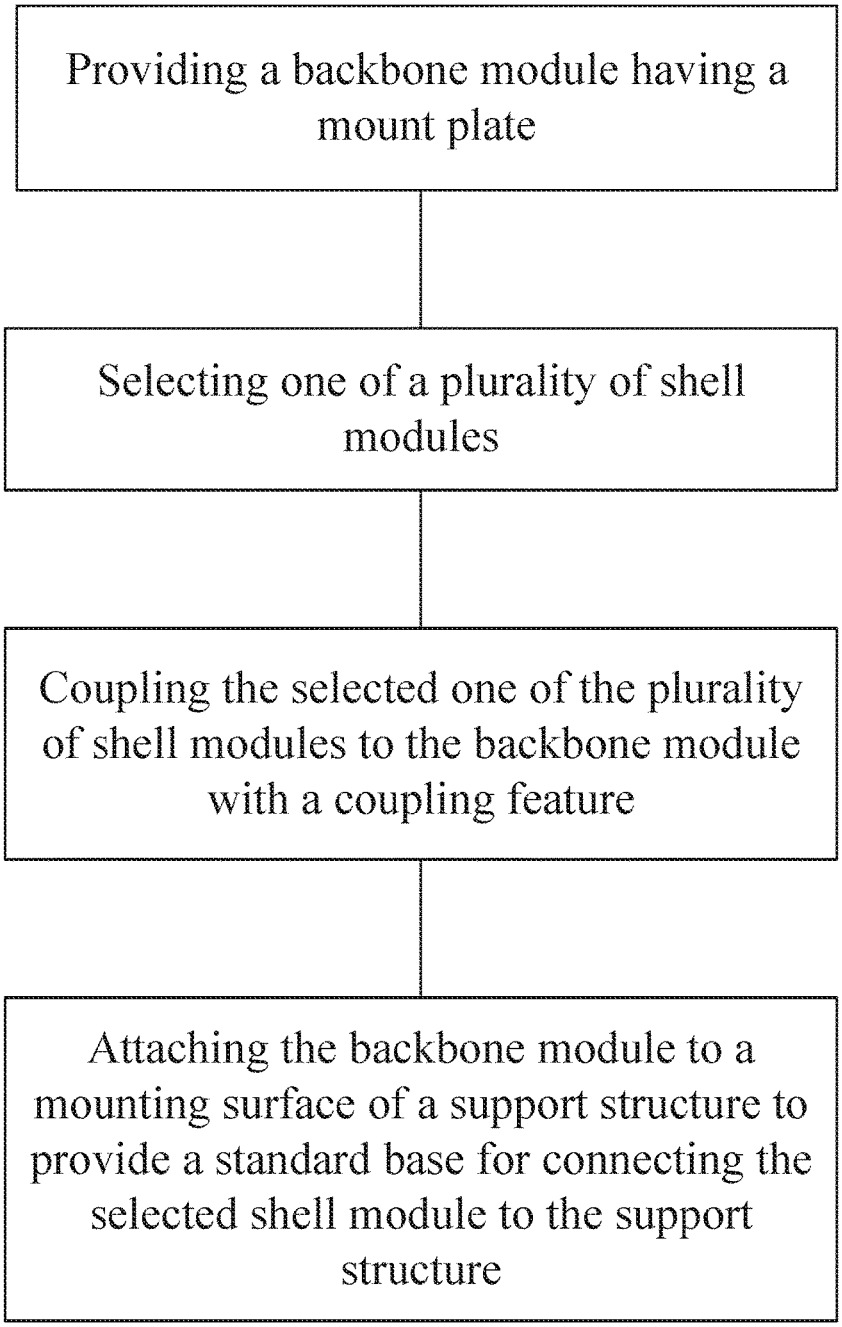
FIG. 13 is a schematic diagram of installing a modular range hood system according to an example of the present disclosure.

As depicted in FIGS. 1-3A, a modular range hood system 20, according to an example of the present disclosure, can include a backbone module 22 for coupling the range hood system 20 to a cabinet 10 or other support structure. As illustrated in FIG. 13, a shell module 24 can be coupled to the backbone module 22, the shell module 24 defining a nose portion and/or other exterior portions of the modular range hood system 20. Different shell modules 24 having different aesthetic characteristics and/or functional features can be coupled to a standard backbone module like the backbone module 22 to change the appearance or functionality of the modular range hood system 20. A ventilation module 26 can be coupled to the backbone module 22, wherein each ventilation module 26 can include at least one of a blower, filter, damper, or other ventilation related apparatus. Different ventilation modules 26 or different combinations of ventilation modules 26 can be coupled to the backbone module 22 to provide different ventilation related functionality to the modular range hood system 20. In this configuration, the backbone module 22 can be mounted to the cabinet 10 to operably mount the shell module 24 and ventilation module 26 to the cabinet 10. This configuration standardizes the portion of the modular range hood system 20 that is mounted to the cabinet 10 and permits selection of different shell modules 24 and ventilation modules 26 to customize the modular range hood system 20.

Figure 3A:
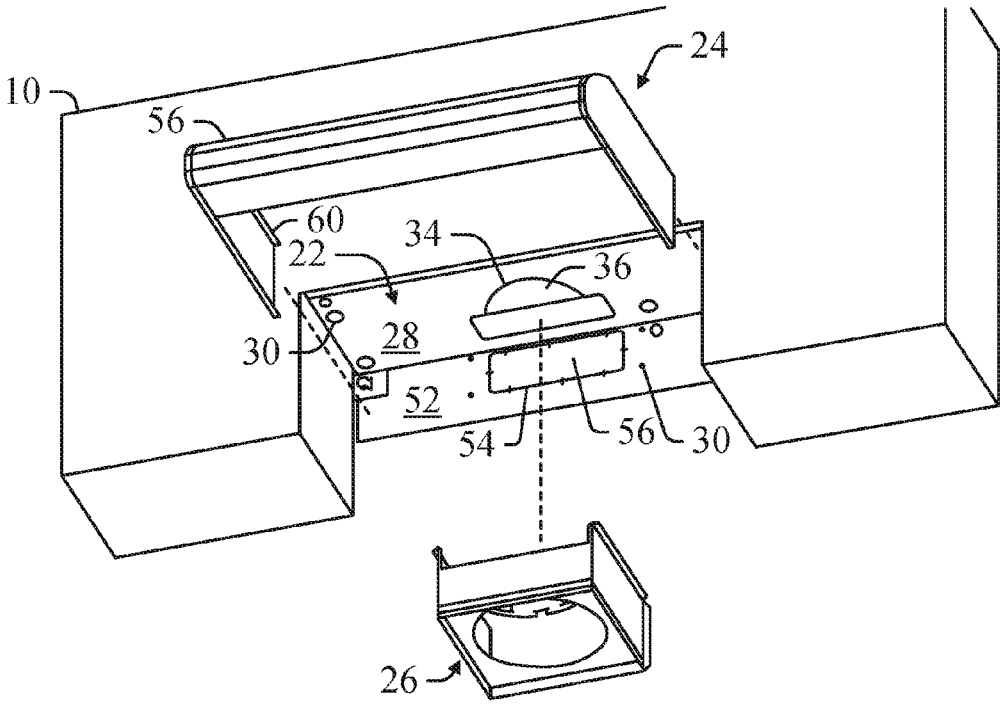
FIG. 3A is a top perspective view of a modular range hood system coupled to a cabinet according to an example of the present disclosure.

In an example, the backbone module 22 can include a mount plate 28 having at least one mounting feature 30 for coupling the backbone module 22 to an underside mounting surface of the cabinet 10 or other surface of a support structure. Each mounting feature 30 can be configured to be adhered, cemented, welded, or configured to receive a fastener, such as a screw, bolt or nail, to attach the mount plate 28 to the cabinet 10 as illustrated in FIG. 3. In the example depicted in FIG. 3A, the mount plate 28 is mounted to the underside mounting surface of the cabinet 10. In that depicted example, the mount plate 28 does not extend beyond the mounting surface so that different shell modules 24 having different aesthetic characteristics can be coupled to the mount plate 28 to change the appearance of the modular range hood system 20.

Figure 1:
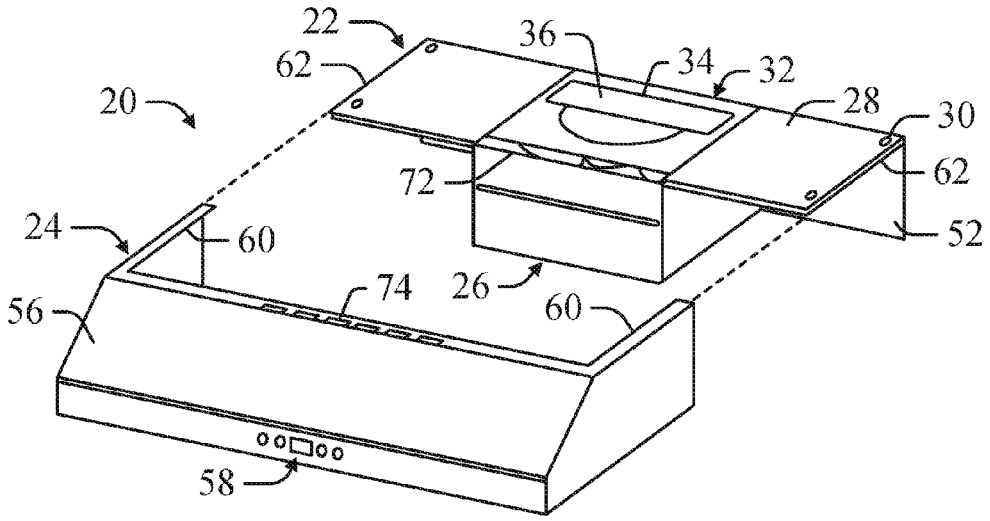
FIG. 1 is a top perspective view of a modular range hood system according to an example of the present disclosure.
Figure 2:
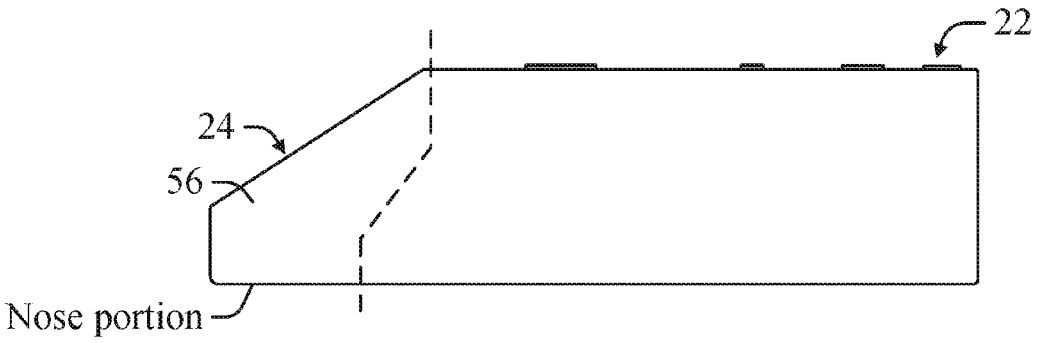
FIG. 2 is a side view of the modular range hood system depicted in FIG. 1 with a shell module coupled to the backbone module according to an example of the present disclosure.

As depicted in FIGS. 1 and 3A, the mount plate 28 can include a duct interface portion 32 for interfacing with ducting 12 of a duct system for the building. The mount plate 28 can define a duct opening 34 at the duct interface portion 32 permitting air to flow through the mount plate 28 into or out of the duct system for the building. A duct plate 36 can be positioned within the duct opening 34 to close the duct opening 34, when not in use. In an example, the removable duct plate 36 can include at least two sections that can be individually removed or removed together to provide a duct opening 34 having a desired shape or size.

Figure 4:
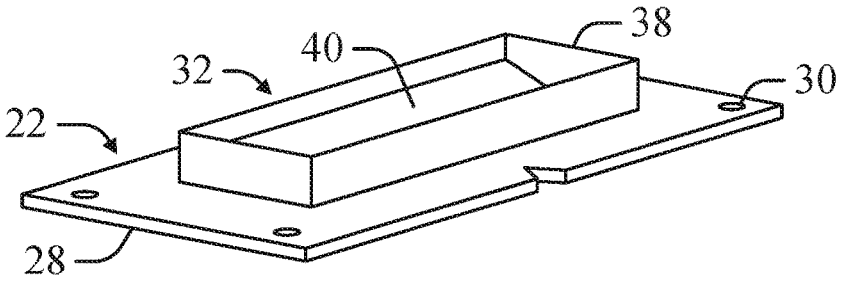
FIG. 4 is a perspective view of a backbone module according to an example of the present disclosure.
Figure 5:
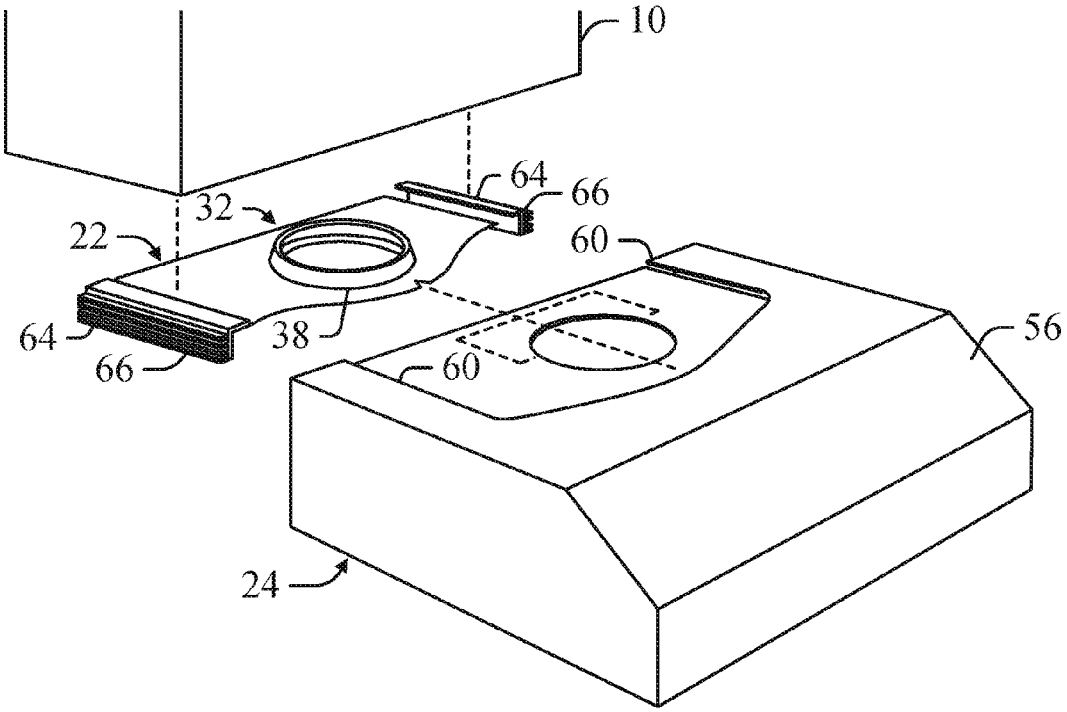
FIG. 5 is a top perspective view of a modular range hood system illustrating coupling of the modular range hood system to a cabinet according to an example of the present disclosure.

The mount plate 28 can include a duct mount 38 shaped and sized to interface with the ducting 12 of the duct system. The duct mount 38 can be rectangular as illustrated in FIG. 4 or round as illustrated in FIG. 5. In other examples, a duct mount in accordance with this disclosure can have different shapes such as rectangular and round shapes. In an example, the duct mount 38 can include an integrated damper 40 for selectively controlling the airflow through the duct mount 38 and into or out of the duct system.

Figure 8:
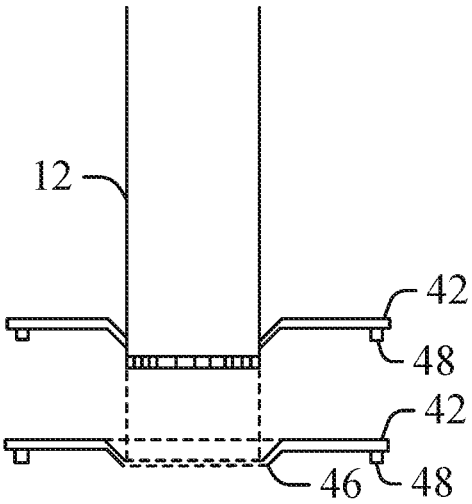
FIG. 8 is a side view illustrating attachment of the adapter plate depicted in FIG. 7 to ducting according to an example of the present disclosure.
Figure 9:
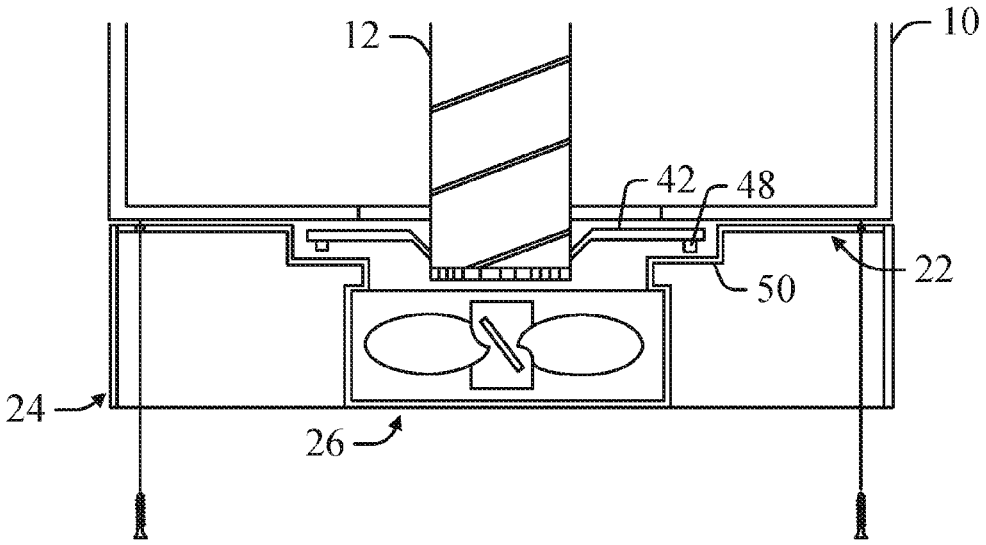
FIG. 9 is partial cross-sectional side view of a modular range hood system coupled to a cabinet with an adapter plate according to an example of the present disclosure.
Figure 10:
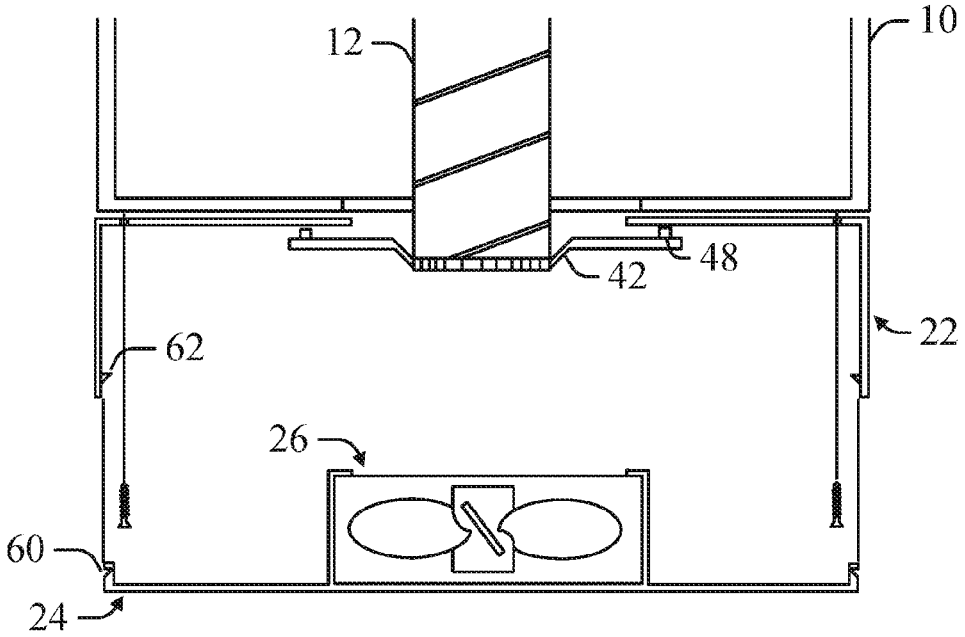
FIG. 10 is partial cross-sectional side view of a modular range hood system coupled to a cabinet with an adapter plate according to an example of the present disclosure.

As depicted in FIGS. 7-10, an adapter plate 42 can be coupled to the ducting 12 to facilitate coupling of the ducting 12 to mount plate 28. The adapter plate 42 can define a duct port 44 and a plurality of fingers 46 arranged around the duct port 44. The plurality of fingers 46 can be biased, for example, radially inward. An end of the ducting 12 can be inserted through the duct port 44 such that the plurality of fingers 46 grip the ducting 12 as illustrated in FIG. 8. The mount plate 28 at the duct interface portion 32 interfaces with the adapter plate 42 to inhibit leakage of air between the backbone module 22 and the cabinet 10. The adapter plate 42 can include a gasket 48 that can engage the mount plate 28 to further inhibit or prevent air leakage. In an example, the mount plate 28 can define a recess 50 for receiving the adapter plate 42 upon mounting the backbone module 22 as depicted in FIG. 9.

As depicted in FIGS. 1 and 3A, the backbone module 22 can include a back plate 52 mountable to a wall or other support structure behind the cabinet 10. At least one mounting feature 30 can be positioned on the back plate 40. Each mounting feature 30 can be configured to be adhered, cemented, welded, or configured to receive a fastener, such as a screw, bolt or nail, to attach the back plate 52 to the wall or other structure. The back plate 52 can define a back port 54 through which electrical cabling and/or piping can be inserted through the back plate 40. A wiring plate 55 can be positioned within the back port 54 to cover the back port 54 if not in use.

Figure 11A:
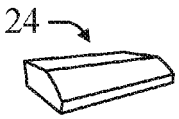
FIGS. 11A-P is a perspective view of a modular shell according to an example of the present disclosure.
Figure 11B:
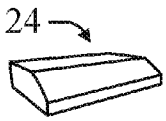
Figure 11C:
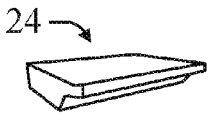
Figure 11D:
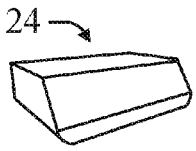
Figure 11E:
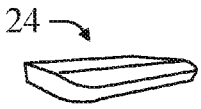
Figure 11F:
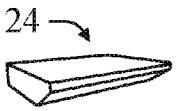
Figure 11G:
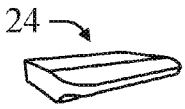
Figure 11H:
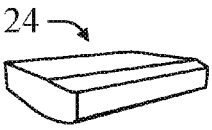
Figure 11I:
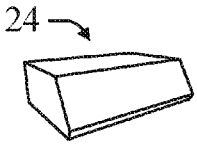
Figure 11J:
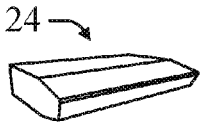
Figure 11K:
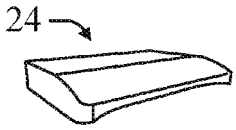
Figure 11L:
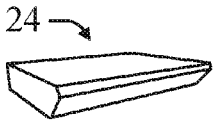
Figure 11M:
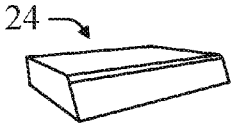
Figure 11N:
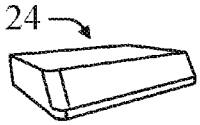
Figure 11O:
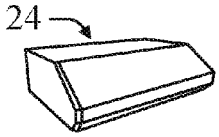
Figure 11P:
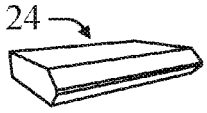

As depicted in FIGS. 1-3A, the shell module 24 can include an exterior shell 56 defining a nose portion and/or other exterior surface of the modular range hood 20. The exterior shell 56 can have different shapes or dimensions, for example, as illustrated in FIGS. 11A-P, to provide different aesthetic appearances. In the embodiment depicted in FIG. 3A, only the shell module 24 extends beyond the cabinet 10 and the backbone module 22 does not so that different shell modules 24 having different aesthetic characteristics can be coupled to the mount plate 28 to change the appearance of the modular range hood system 20. The shell module 24 can include a control interface 58 positioned on the exterior shell 56. In an example, shell module 24 can include a controller that can be connected to the ventilation modules 26 such that manual operation of the control interface 58 controls operation of the ventilation module 26. The shell module 24 can include a door panel for accessing the controller for repairing or replacing the controller without removing the shell module 24.

Figure 3B:
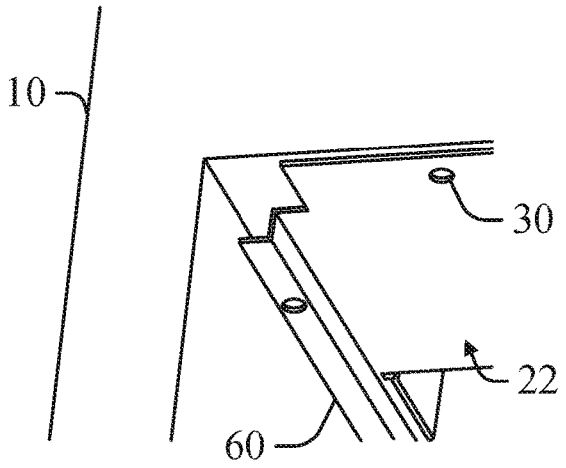
FIG. 3B is a partial perspective view of a modular range hood system according to an example of the present disclosure.

As depicted in FIGS. 1 and 3A-3B, in an example, the shell module 24 can include at least one coupling feature 60 that can be engaged to an attachment feature 62 of the backbone module 22 to couple the shell module 24 to the backbone module 22. The coupling feature 60 can comprise a flange and the attachment feature 62 can comprise a corresponding flange, wherein the flange of the coupling feature 60 can be overlapped with the corresponding flange of the attachment feature 62. The flanges can be welded, adhered together, or configured to receive at least one fastener through the flanges (as illustrated in FIG. 3B) to couple the shell module 24 to the backbone module 22. The flanged configuration allows the shell module 24 to be slid into engagement with the backbone module 22 following mounting of the backbone module 22 to the cabinet 10 without unmounting module 22. This configuration also allows the shell module 24 to be removed and replaced.

Figure 6:
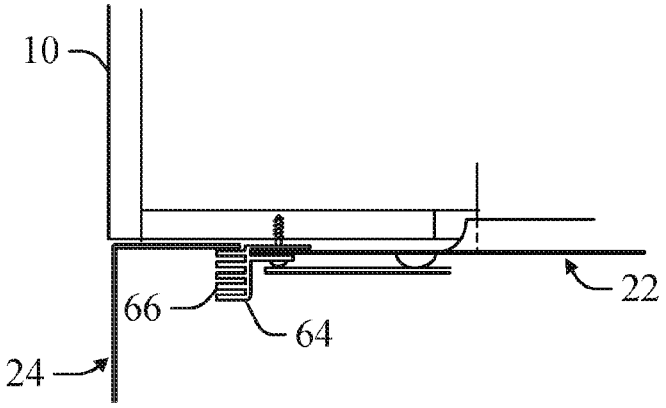
FIG. 6 is a partial cross-sectional view of attachment of a modular shell to a stacked attachment feature of a backbone module according to an example of the present disclosure.
Figure 7:
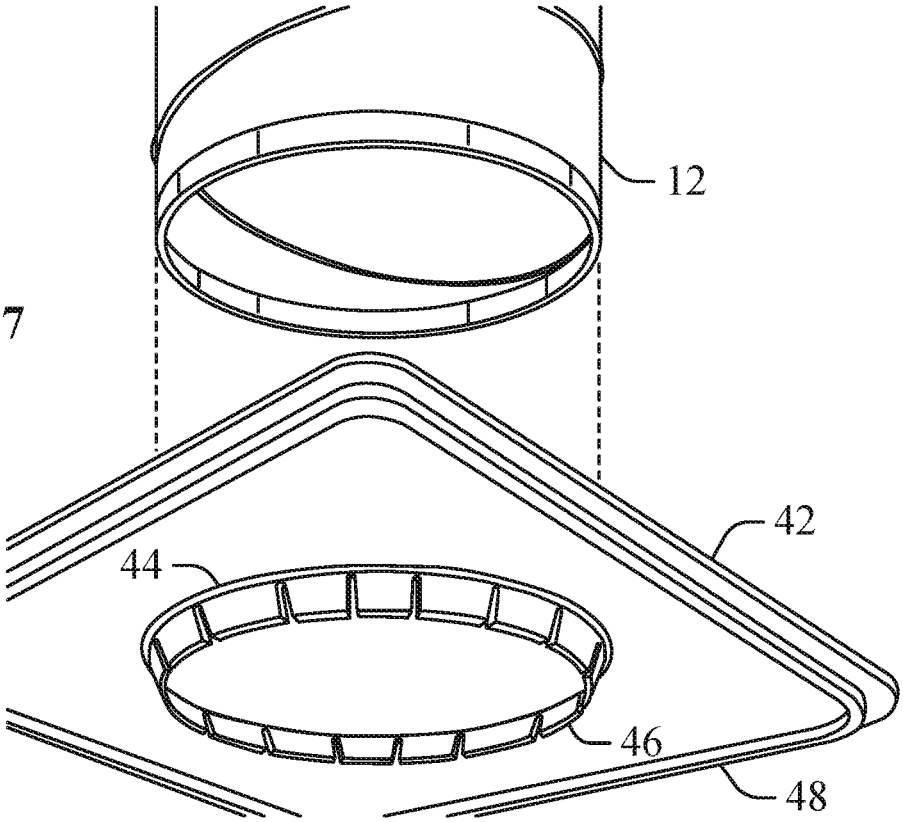
FIG. 7 is a perspective view illustrating attachment of an adapter plate to ducting according to an example of the present disclosure.

As depicted in FIGS. 5-6, in an example, the backbone module 22 can include a height adjustment feature 64 having a plurality of stacked attachment features 66. The stacked attachment feature 66 can be arranged vertically. In this configuration, the coupling feature 60 of the shell module 24 can be coupled to one of the stacked attachment features 66 to position the shell module 24 at a first height relative to the cabinet 10. The shell module 24 can be coupled to a different stacked attachment feature 66 to position the shell module to a second height, as illustrated in FIG. 6. This allows the height of the shell module 24 to be adjusted relative to the backbone module 22.

Figure 12:
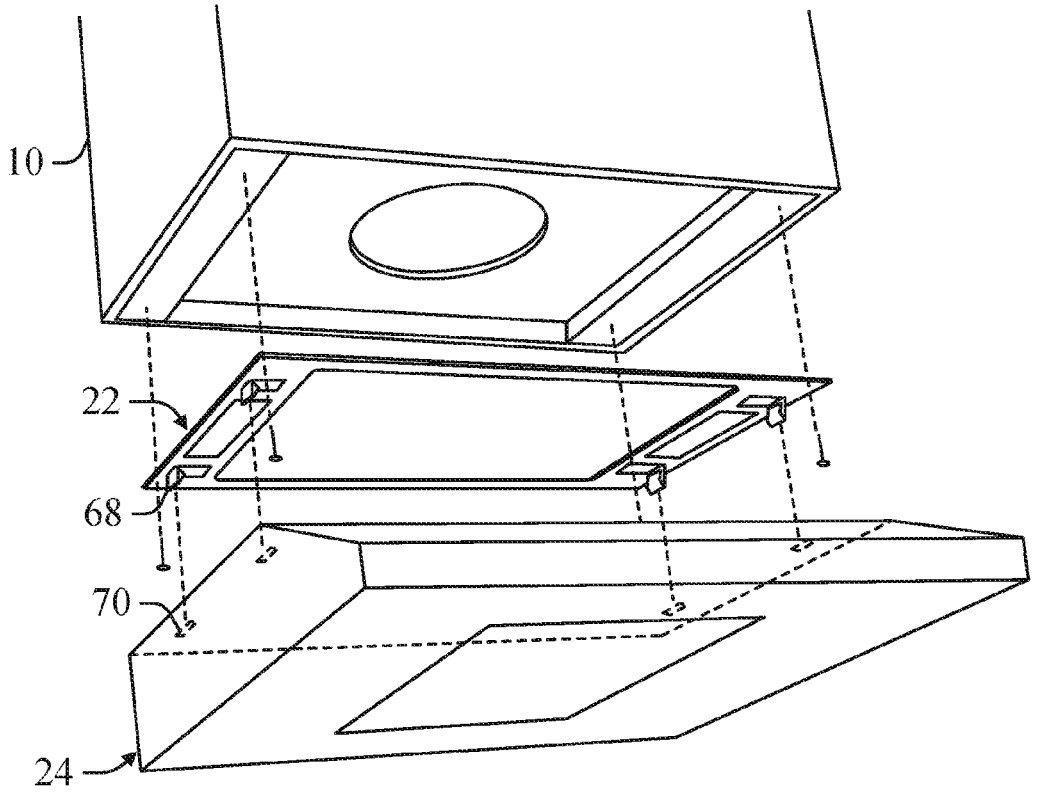
FIG. 12 is a bottom perspective view of a modular range hood system illustrating coupling of the modular range hood system to a cabinet according to an example of the present disclosure.

As depicted in FIG. 12, the backbone module 22 can include a snap-in attachment feature 68 engagable to a slot 70 defined in the exterior shell 56 of the shell module 24. The snap-in attachment feature 68 can be inserted into the slot 70 to engage the shell module 24 to the backbone module 22. This arrangement permits mounting of the shell module 24 to backbone module 22 coupled to a cabinet 10 by aligning the snap-in attachment feature 68 with the corresponding slot 70 and lifting the shell module 24 to insert the snap-in attachment feature 68 into the corresponding slot 70.

As depicted in FIGS. 1 and 3A, at least one ventilation module 26 can be coupled to the mount plate 28 at the duct interface portion 32. The ventilation module 26 can control airflow through the duct system, generate an airflow through the duct system, filter airflow through the duct system, or otherwise operate on/affect the airflow through the duct system. In an example, at least two ventilation module 26 can be mounted to the mount plate 28 in a stacked configuration. For example, a first ventilation module 26 having a blower for generating an airflow can be mounted to the mount plate 28 and a second ventilation module 26 having a filter can be mounted below the first ventilation module 26 to filter the airflow generated by the first ventilation module 26.

As depicted in FIG. 1, the ventilation module 26 can be coupled to the backbone module 22 to define an air intake port 72. The shell module 24 can have at least one upper vent 74 positioned to align with the air intake port 72 when the shell module 24 is fitted to the backbone module 22. The upper vent 74 position on the exterior shell 56 can be standardized such that the upper vent 74 aligns with the air intake port 72 despite other portions of exterior shell 56 having a different size or shape.

VARIOUS NOTES & EXAMPLES

Example 1 is a modular range hood system, comprising: a backbone module having a mount plate; and a shell module having a coupling feature for attaching the shell module to the backbone module; wherein the mount plate is attachable to a mounting surface of a support structure to provide a standard base for operably connecting the shell module to the support structure.

In Example 2, the subject matter of Example 1 optionally includes wherein the mount plate defines a duct opening and has a duct interface portion configured to couple the backbone module to ducting; wherein the duct opening permits airflow through the mount plate into the ducting.

In Example 3, the subject matter of Example 2 optionally includes wherein the mount plate further comprises a duct mount configured to engage an end of the ducting to couple the ducting to the backbone module.

In Example 4, the subject matter of any one or more of Examples 2-3 optionally include an adapter plate defining a duct port and including a plurality of fingers positioned around the duct port, wherein the plurality of fingers are biased inward such that ducting can be inserted through the duct port and coupled to the adapter plate by the plurality of fingers; wherein the adapter plate is configured to engage the duct interface portion of the mount plate to limit leakage between the ducting and the mount plate.

In Example 5, the subject matter of Example 4 optionally includes wherein the adapter plate includes a gasket to engage the mount plate to inhibit air leakage between the adapter plate and the mount plate.

In Example 6, the subject matter of any one or more of Examples 2-5 optionally include a ventilation module configured to couple to the backbone module at the duct interface portion; wherein the ventilation module is configured to provide a ventilation function including at least one of generating an airflow through the ducting, controlling the airflow, and filtering the airflow.

In Example 7, the subject matter of Example 6 optionally includes wherein the ventilation module is mounted to the backbone module to define an air intake port adjacent the mount plate.

In Example 8, the subject matter of Example 7 optionally includes wherein the shell module comprises at least one upper vent positioned to align with the air intake port when the shell module is coupled to the backbone module.

In Example 9, the subject matter of any one or more of Examples 6-8 optionally include a second ventilation module configured to couple to the ventilation module in a stacked configuration to provide a second ventilation function.

In Example 10, the subject matter of any one or more of Examples 1-9 optionally include wherein the backbone module further comprises: a back plate oriented transverse to the mount plate, the back plate configured to mount to a second support structure.

In Example 11, the subject matter of any one or more of Examples 1-10 optionally include wherein the backbone module further comprises: a height adjustment feature comprising a plurality of stacked attachment features arranged vertically; wherein the coupling feature is configured to be coupled to one of the stacked attachment features to position the backbone module at a first height relative to the backbone module.

In Example 12, the subject matter of Example 11 optionally includes wherein the coupling feature can be coupled to a second of the stacked attachment features to position the backbone module at a second height relative to the backbone module.

In Example 13, the subject matter of any one or more of Examples 1-12. optionally include wherein the backbone module further comprises: at least one snap-in attachment feature; wherein the coupling feature defines a slot for receiving the snap-in attachment feature to couple the shell module to the backbone module. In Example 14, the subject matter of any one or more of Examples 1-13 optionally include wherein the backbone module further comprises: a flanged attachment feature; wherein the coupling feature defines flange for slide on engagement of the shell module to the backbone module.

Example 15 is a method of providing a range hood, comprising: providing a backbone module having a mount plate; selecting one of a plurality of shell modules, each of the plurality of shell modules comprising a coupling feature to couple the respective shell module to the backbone module; coupling the one of the plurality of shell modules to the backbone module with a coupling feature; attaching the backbone module to a mounting surface of a support structure to provide a standard base for operably connecting the shell module to the support structure.

In Example 16, the subject matter of Example 15 optionally includes coupling the backbone module to ducting at a duct interface portion of the mount plate; wherein the mount plate defines a duct opening to permit airflow through the mount plate into the ducting.

In Example 17, the subject matter of any one or more of Examples 15-16 optionally include coupling the coupling feature of the shell module to one of a plurality of vertically arranged stacked attachment features of a height adjustment feature to position the shell module at a first height relative to the backbone module.

In Example 18, the subject matter of Example 17 optionally includes coupling the coupling feature of the shell module to another of plurality of the stacked attachment features to position the shell module at a second height relative to the backbone module.

In Example 19, the subject matter of any one or more of Examples 15-18 optionally include sliding the coupling feature of the shell module onto a flanged attachment feature of the backbone module to couple the shell module to the backbone module.

In Example 20, the subject matter of Example 19 optionally includes sliding the shell module horizontally relative to the backbone module to decouple the shell module from the backbone module.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A modular range hood system, comprising:

a backbone module comprising a mount plate for attaching the backbone module to the underside mounting surface of a support structure; and a ventilation module selected from a plurality of different ventilation modules, the ventilation module coupled to the mount plate, the ventilation module configured to provide a ventilation function including at least one of generating an airflow through the ducting, controlling the airflow, and filtering the airflow; and a plurality of interchangeable shell modules comprising at least a first shell module and a second shell module and the first shell module having different aesthetic characteristics, such as shape or size, and/or functional features than the second shell module, each of the first and second shell modules having a coupling feature for attaching the shell module to the backbone module;

wherein the mount plate is attachable to the underside mounting surface of the support structure to provide a standard base for operably connecting either the first shell module or the second shell module to the support structure.

2. The modular range hood system of claim 1, wherein the mount plate defines a duct opening and has a duct interface portion configured to couple the backbone module to ducting;

wherein the duct opening permits airflow through the mount plate into the ducting.

3. The modular range hood system of claim 2, wherein the mount plate further comprises a duct mount configured to engage an end of the ducting to couple the ducting to the backbone module.

4. The modular range hood system of claim 2, further comprising:

an adapter plate defining a duct port and including a plurality of fingers positioned around the duct port, wherein the plurality of fingers are biased inward such that ducting can be inserted through the duct port and coupled to the adapter plate by the plurality of fingers;

wherein the adapter plate is configured to engage the duct interface portion of the mount plate to limit leakage between the ducting and the mount plate.

5. The modular range hood system of claim 4, wherein the adapter plate includes a gasket to engage the mount plate to inhibit air leakage between the adapter plate and the mount plate.

6. The modular range hood system of claim 2, further comprising:

the ventilation module configured to couple to the backbone module at the duct interface portion.

7. The modular range hood system of claim 6, wherein the ventilation module is mounted to the backbone module to define an air intake port adjacent the mount plate.

8. The modular range hood system of claim 7, wherein the shell module comprises at least one upper vent positioned to align with the air intake port when the shell module is coupled to the backbone module.

9. The modular range hood system of claim 6, further comprising:

a second ventilation module configured to couple to the ventilation module in a stacked configuration to provide a second ventilation function.

10. The modular range hood system of claim 1, wherein the backbone module further comprises:

a back plate oriented transverse to the mount plate, the back plate configured to mount to a second support structure.

11. The modular range hood system of claim 1, wherein the backbone module further comprises:

a height adjustment feature comprising a plurality of stacked attachment features arranged vertically;

wherein the coupling feature is configured to be coupled to one of the stacked attachment features to position the backbone module at a first height relative to the height adjustment feature.

12. The modular range hood system of claim 11, wherein the coupling feature can be coupled to a second of the stacked attachment features to position the backbone module at a second height relative to the backbone module.

13. The modular range hood system of claim 1, wherein the backbone module further comprises:

at least one snap-in attachment feature;

wherein the coupling feature defines a slot for receiving the snap-in attachment feature to couple the shell module to the backbone module.

14. The modular range hood system of claim 1, wherein the backbone module further comprises:

a flanged attachment feature;

wherein the coupling feature defines a flange for slide on engagement of the shell module to the backbone module.

15. A method of providing a range hood, comprising:

providing a backbone module comprising a mount plate and a ventilation module coupled to the mounting plate, the ventilation module selected from a plurality of different ventilation module;

providing a plurality of interchangeable shell modules, at least a first of the plurality of shell modules having different aesthetic characteristics, such as shape or size, and/or functional features than a second of the plurality of shell modules;

selecting one of the plurality of shell modules, each of the plurality of shell modules comprising a coupling feature to couple the respective shell module to the backbone module;

coupling the selected one of the plurality of shell modules to the backbone module with a coupling feature;

attaching the backbone module to a mounting surface of a support structure to provide a standard base for operably connecting the shell module to the support structure such that the mount plate does not extend beyond the mounting surface.

16. The method of claim 15, further comprising:

coupling the backbone module to ducting at a duct interface portion of the mount plate;

wherein the mount plate defines a duct opening to permit airflow through the mount plate into the ducting.

17. The method of claim 15, further comprising:

coupling the coupling feature of the shell module to one of a plurality of vertically arranged stacked attachment features of a height adjustment feature to position the shell module at a first height relative to the backbone module.

18. The method of claim 17, further comprising:

coupling the coupling feature of the shell module to another of plurality of the stacked attachment features to position the shell module at a second height relative to the backbone module.

19. The method of claim 15, further comprising:

sliding the coupling feature of the shell module onto a flanged attachment feature of the backbone module to couple the shell module to the backbone module.

20. The method of claim 19, further comprising:

sliding the shell module horizontally relative to the backbone module to decouple the shell module from the backbone module.

21. A modular range hood system, comprising:

a backbone module comprising a mount plate for attaching the backbone module to the underside mounting surface of a support structure, and a ventilation module selected from a plurality of different ventilation modules, the ventilation module coupled to the mount plate; and a plurality of interchangeable shell modules comprising at least a first shell module and a second shell module and the first shell module having different aesthetic characteristics, such as shape or size, and/or functional features than the second shell module, each of the first and second shell modules having a coupling feature for attaching the shell module to the backbone module;

wherein the mount plate is attachable to the underside mounting surface of the support structure to provide a standard base for operably connecting either the first shell module or the second shell module to the support structure.

* * * * *